US006162408A

United States Patent [19]

Wimby

[11] Patent Number: 6,162,408

[45] Date of Patent: Dec. 19, 2000

[54] PROCESS FOR PURIFYING ASH WHICH PRINCIPALLY CONSISTS OF SODIUM SULPHATE FROM A RECOVERY BOILER

[75] Inventor: Martin Wimby, Goteborg, Sweden

[73] Assignee: Kvaerner Pulping AB, Sweden

[21] Appl. No.: 09/284,855

[22] PCT Filed: Oct. 21, 1997

[86] PCT No.: PCT/SE97/01756

§ 371 Date: Apr. 19, 1999

§ 102(e) Date: Apr. 19, 1999

[87] PCT Pub. No.: WO98/19003

PCT Pub. Date: May 7, 1998

[30] Foreign Application Priority Data

Oct. 31, 1996 [SE] Sweden ..... 9603972

[51] Int. Cl.[7] ..... C22B 26/10; D21C 11/12; D21C 11/14

[52] U.S. Cl. ..... 423/184; 423/208; 162/30.1

[58] Field of Search ..... 423/184, 208, 423/201; 162/29, 30.1

[56] References Cited

U.S. PATENT DOCUMENTS

| | | | |
|---|---|---|---|
| 5,352,332 | 10/1994 | Maples et al. | 162/30.1 |
| 5,938,892 | 8/1999 | Maples et al. | 162/30.1 |
| 5,980,717 | 11/1999 | Pudas et al. | 423/181 |

FOREIGN PATENT DOCUMENTS

| | | |
|---|---|---|
| 1059271 | 7/1979 | Canada . |
| 0754799 A2 | 1/1997 | European Pat. Off. . |
| WO 9612847 A1 | 5/1996 | WIPO . |

OTHER PUBLICATIONS

File WPI, Derwent accession No. 81–57548D, Nippon Chem Plant, "Sepn. of Glauber's salt and sodium chloride from soln.—by crystallisation of anhydrous glauber's salt, crystallising the deca–hydrate and crystallising salt"; & JP,A, 56073620 810618; & Patent Abstract of Japan, vol. 5, No. 140, abstract of JP,A,56–073620 (Tokuyama Soda Co Ltd), Jun. 18, 1981; & JP,A,56–073620, 810618, see figure, table, col. 4, line 19, col. 10, line 20—col. 11, line 1.

*Primary Examiner*—Steven Bos
*Attorney, Agent, or Firm*—Fasth Law Offices; Rolf Fasth

[57] ABSTRACT

Ash from a recovery boiler is purified by leaching or evaporation-crystallizing contaminants such as, chlorides and potassium salts in water. The leaching or evaporation-crystallizing takes place in an aqueous solution at a temperature that is in the vicinity of the boiling point of the aqueous solution. The leached or evaporation-crystallized ash is returned to the black liquor or to the recovery boiler while the leaching water or the evaporation-crystallization water is then cooled to less than 32° C., preferably 10–15° C. Sodium sulphate containing crystallization water, such as sodium sulphate heptahyfdrate or sodium sulphate decahydrate, is crystallized out and then separated to be reintroduced into the black liquor, directly into the recovery boiler or into the leaching solution or evaporation-crystallization solution.

14 Claims, 1 Drawing Sheet

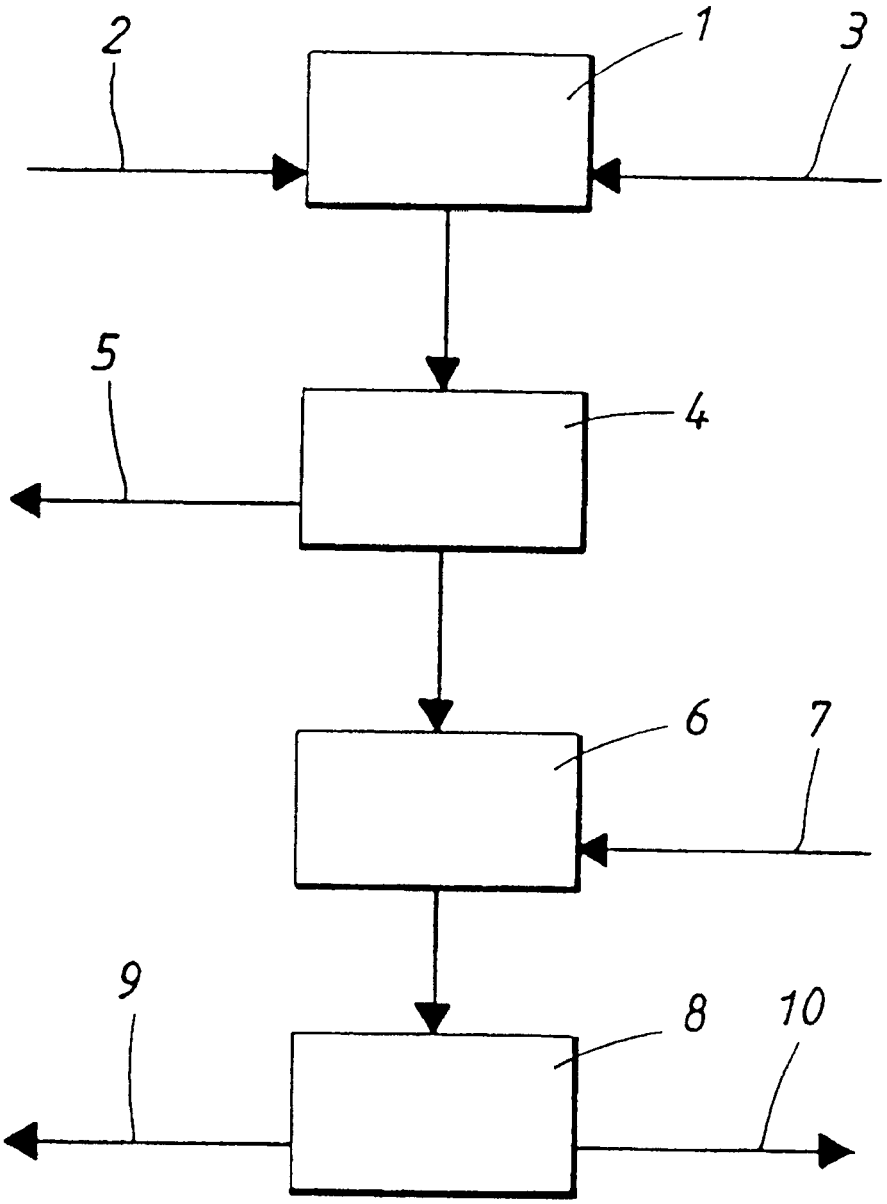
1
2
3
4
5
6
7
8
9
10

PROCESS FOR PURIFYING ASH WHICH PRINCIPALLY CONSISTS OF SODIUM SULPHATE FROM A RECOVERY BOILER

TECHNICAL FIELD

The present invention relates to purifying the fly ash which is collected from recovery boilers and utilized and which principally consists of sodium sulphate containing contaminants such as chlorides, potassium salts and carbonates.

BACKGROUND AND SUMMARY OF THE INVENTION

When spent liquors from the pulp industry, in particular so-called black liquor, which is present in concentrated form, are combusted in a recovery boiler, the water evaporates while the organic material in the liquor, mainly lignin residues, is combusted and inorganic chemicals, in smelt form, run down along the walls and collect in the bottom of the boiler. These chemicals are recovered and used again in the pulp cooking.

However, during the combustion, it is impossible to prevent dust from accompanying the flue gases and becoming stuck to the tubes in the heat exchanger which the flue gases have to flow through. This dust is brushed off and collected as ash. It consists princi pally of sodium sulphate to an extent of about 90%, chlorides and carbonates to an extent of 7–8% and potassium to an extent of 3–4%. While the sodium sulphate can be reused, the potassium, which is principally derived from the wood, and the chlorides and carbonates, have to be removed.

Several processes for purifying this ash have been disclosed. Most of them are based on leaching the ash in a container, in association with which chlorides, potassium salts and the like go in solution. This leaching can take place both at an elevated temperature and at a lower temperature, for example less than 20° C. Processes of this nature are described, for example, in WO96/12847, the published Japanese Patent Application No. 311462/1994 and the U.S. Pat. No. 5,352,332.

If a leaching is to provide the desired result, such that the contaminants are leached out from the substance which it is desired to retain in a solid state, the contaminants have to be soluble in the leaching medium, in this case water, while the solid substance which it is desired to retain has to be of lower solubility. However, sodium sulphate is also soluble in water and there will therefore be losses during the leaching. However, the solubility of sodium sulphate decreases as the temperature decreases, in contrast to the solubility of potassium salts, which is virtually independent of the temperature. The chlorides are also readily soluble at both high and low temperatures. The problem with the above-disclosed processes has been that it has not been possible to achieve the desired selectivity between potassium and sodium salts, i.e. such that the sodium sulphate can be recovered from the leaching process and supplied to black liquor for combustion while the potassium salts remain in solution.

Another problem with the known leaching methods is that, if these methods are carried out in lukewarm or cold water, i.e. at less than approx. 32° C., when the solubility of the sodium sulphate is low, the sodium sulphate will become surrounded by water molecules and form sodium sulphate heptahydrate or, more usually, sodium sulphate decahydrate. If the sodium sulphate is returned to the black liquor in this form, the concentrated black liquor will then be diluted with this water, something which naturally constitutes an undesirable problem.

There has therefore long been a great need to be able to utilize the ash from the recovery boiler by being able to return practically all the sodium sulphate, virtually free of potassium salts and chlorides, to the black liquor, without dilution water being supplied to the black liquor, and a process has been developed, in accordance with the invention, for purifying ash from a recovery boiler, which ash consists principally of sodium sulphate, by leaching or evaporation-crystallizing contaminants consisting mainly of chlorides and potassium salts in water, which process is characterized in that the leaching or the evaporation-crystallization takes place in an aqueous solution at a temperature of greater than approximately 32° C., preferably in the vicinity of the boiling point of the aqueous solution, with leached or evaporationcrystallized ash being returned to the black liquor which is to be combusted or returned directly into the recovery boiler, with the leaching water or the evaporation-crystallization liquid being cooled to less than approximately 32° C., preferably to approximately 10–15° C., with the sodium sulphate con-taining water of crystallization, such as sodium sulphate decahydrate or sodium sulphate heptahydrate, being crystallized out and then separated in order to be reintroduced into the black liquor, directly into the recovery boiler or into the leaching solution or evaporation-crystallization solution.

According to the process, it is expedient for the ratio between ash and water in the leaching apparatus to be approximately 1:1.

According to the process, the leached or evaporation-crystallized ash can expediently be subjected to a washing in water or an organic solvent which dispels the water.

According to the invention, it is also expedient in many cases for water to be added to the leaching or evaporation-crystallization water before or during the cooling-down in order to ensure that sufficient water is present for the crystallization.

BRIEF DESCRIPTION OF THE FIGURE

In that which follows, the invention will be described in more detail with reference to the attached FIGURE, which constitutes a flow diagram for the process.

DETAILED DESCRIPTION

Ash 2 and water 3 are added to a mixing vessel 1 which is equipped with a stirrer. During leaching, the quantities of ash and water can be approximately the same. If a large quantity of carbonate is present in the ash, the pH can be adjusted to approximately 10 using, for example, dilute sulphuric acid. The substance in the leaching container 1 has a consistency resembling porridge, and heat is supplied to this porridge or sludge so that its temperature is raised to well over 32° C., since sodium sulphate crystallizes with water of crystallization below this temperature. It is expedient for the temperature to be as high as possible in order to increase the speed of the process, namely the dissolution of chlorides and potassium salts. A suitable temperature can be in the vicinity of the boiling temperature of the liquid, i.e. in the region of 100° C., or higher if the leaching takes place under pressure. Since sodium sulphate also dissolves in water at high temperature, some of the sodium sulphate will be dissolved; however, it will be recovered at a later stage in the process.

According to the present invention, an excess of water can also be added so that all the solid material, including the sodium sulphate, dissolves, after which the water is evaporated at a temperature in the vicinity of the boiling temperature such that the sodium sulphate precipitates out again. This sodium sulphate is then pure and does not contain any water of crystallization.

After the leaching or evaporation-crystallizaion, the solid sodium sulphate is separated from the leaching or evaporation-crystallization liquid in stage 4. The sodium sulphate 5, which is virtually water-free, is supplied to new black liquor or fed directly into a recovery boiler. If desired, the sodium sulphate can, prior to being fed-in, be washed with water and then dried, or can be washed with an organic solvent which dispels the water. The organic solvent, which will accompany the sodium sulphate, will then be burnt in the recovery boiler. From the separation stage 4, the aqueous solution goes to the cooling stage 6, in which cooling to below 32° C., preferably to 10–15° C., takes place. In this stage, sodium sulphate containing water of crystallization precipitates out, mainly in the form of sodium sulphate decahydrate or sodium sulphate heptahydrate. No potassium salts precipitate out during the cooling, since the potassium salts are virtually temperature-independent. The chlorides are also soluble at these temperatures.

It may be necessary to add a little water 7 to this stage 6 in order to ensure that sufficient water is available for forming the water of crystallization in the sodium sulphate.

After the cooling stage 6, the mixture is subjected to a separation in stage 8, in which sodium sulphate containing water of crystallization is separated from liquid containing dissolved chlorides and potassium salts. The separated sodium sulphate 9 is then mixed with black liquor or fed directly into a recovery boiler. In this way, however, the black liquor or the recovery boiler will be supplied with water of crystallization, something which is undesirable. However, since only a relatively small portion of the sodium sulphate containing water of crystallization is returned in this way, the quantity of water which dilutes the black liquor is small.

However, it is also possible to allow only anhydrous sodium sulphate to be returned to the black liquor or the recovery boiler. Thus, the water of crystallization-containing sodium sulphate from separation stage 8 can be returned to the mixing vessel 1, in association with which it loses its water of crystallization whether leaching or evaporation-crystallization is carried out in this vessel. The only sodium sulphate which will then be supplied to the black liquor or the recovery boiler is the anhydrous sodium sulphate from separation stage 4.

The liquid 10 which is separated off by means of separation stage 8 can be discharged as effluent since it essentially contains potassium chloride and sodium chloride which, of course, occur generally in nature and in particular in sea water. However, if it is desirable for the residual water 10 not to be discharged, it can be used as process water in the bleaching process or the like.

EXAMPLE

A quantity of 110 kg of ash containing 104.3 kg of sodium sulphate, 3 kg of potassium and 2.7 kg of chloride was mixed in stage 1 with 95 litres of water. After stirring, and the requisite time for leaching at approximately 100° C., the sodium sulphate was separated in stage 4, with 57.3 kg of sodium sulphate, containing 12.5 kg of water before drying, being obtained.

The mixture was then cooled in stage 6 while at the same time adding 105.5 litres of water in order to ensure that there would be sufficient water for the crystallization.

After the cooling, sodium sulphate separated out in a quantity of 44 kg containing water of crystallization and dissolved water in a quantity of 115 kg. The water which was discharged as effluent amounted to a quantity of 73 kg of water, 3 kg of sodium sulphate, 1.6 kg of potassium and 1.5 kg of chloride.

In this example, the water which was returned to the recovery boiler by way of the black liquor was 127.5 kg, while the loss of sodium sulphate amounted to 2.9% and the separation of potassium and chlorides amounted to 55% in each case.

As a comparison, it can be mentioned that the same quantity of dust, which was mixed with 308 litres of water and only subjected to separation after cooling, gave 100.2 kg of sodium sulphate with a water content of 215 kg of water of crystallization and an effluent water in a quantity of 93 litres containing 4.1 kg of sodium sulphate, 1.5 kg of potassium salts and 1.35 kg of chlorides.

In this case, the quantity of water going to the recovery boiler amounted to 215 kg while the sodium sulphate loss was 3.9% and both the potassium and chloride separations were 50%.

The abovementioned examples are based on producing 1 tonne of air-dried pulp. The corresponding quantity of substance supplied to the recovery boiler is approximately 1700 kg. When the dry substance content of the black liquor is 75%, 567 kg of water are supplied to the boiler. If sodium sulphate decahydrate from the cold-water process is returned in accordance with the comparison example, the quantity of water being supplied to the recovery boiler is increased to 780 kg of water. If the procedure according to the present invention is followed, the quantity of water increases to 694 kg. These increases result in the effective dry substance contents of the black liquor which is supplied to the recovery boiler being 71% and 68.5%, respectively.

By means of leaching or evaporation-crystallizing at high temperature, a relatively large quantity of sodium sulphate is dissolved out since the solubility of the sodium sulphate is higher than that of potassium sulphate at high temperature. However, the quantity of sodium sulphate which has been dissolved out is returned during the subsequent crystallization stage since it is only the sodium sulphate, and not the potassium sulphate, which recrystallizes. The chlorides are highly soluble both at high and low temperature.

Significant drawbacks from the energy point of view are associated with only carrying out a leaching in the cold state in accordance with the state of the art. On the one hand, cooling costs energy and, in addition, the water in the decahydrate places a burden on the recovery water balance either in the recovery boiler or in the evaporation. These drawbacks are greatly minimized by the present invention, since only a relatively small portion has to be cooled. Consequently, the present invention achieves the advantages of good potassium selectivity, a small quantity of water going to the black liquor and little requirement for cooling.

The invention is not limited to the embodiments disclosed above and can be varied in a variety of ways within the scope of the patent claims. While the present invention has been described in accordance with preferred compositions and embodiments, it is to be understood that certain substitutions and alterations may be made thereto without departing from the spirit and scope of the following claims.

What is claimed is:

1. A process for purifying ash from a recovery boiler, the process comprising:

(a) providing ash consisting of sodium sulphate and contaminants comprising chlorides and potassium salts;

(b) leaching the ash in an aqueous solution at a temperature of about the boiling temperature of the aqueous solution and dissolving a portion of the sodium sulphate of the ash in the aqueous solution;

(c) returning the leached ash to a black liquor to be combusted;

(d) cooling the aqueous solution to a temperature that is less than about 32° C.;

(e) crystallizing out the portion of the sodium sulphate from the aqueous solution;

(f) separating the portion of the sodium sulphate from the aqueous solution; and (g) introducing the portion of the sodium sulphate to the black liquor.

2. A process according to claim 1 wherein step (c) comprises returning the leached ash directly into a recovery boiler.

3. A process according to claim 1 wherein step (d) comprises cooling the aqueous solution to a temperature ranging from about 10° C. to about 15° C.

4. A process according to claim 1 wherein the sodium sulphate containing crystallization water contains sodium sulphate heptahydrate.

5. A process according to claim 1 wherein the sodium sulphate containing crystallization water contains sodium sulphate decahydrate.

6. A process according to claim 1 wherein the sodium sulphate containing crystallization water in step (g) is returned directly into a recovery boiler.

7. A process according to claim 4 wherein the sodium sulphate in step (g) is returned directly into the aqueous solution in step (b).

8. A process according to claim 1 wherein a volume ratio between the ash and the aqueous solution in step (b) is 1:1.

9. A process according to claim 1 wherein step (c) further comprises washing the leached ash in water.

10. A process according to claim 1 wherein step (c) further comprises washing the leached ash in an organic solvent.

11. A process according to claim 1 wherein the process further comprises adding water to the aqueous solution prior to step (d).

12. A process according to claim 1 wherein step (d) further comprises adding water to the aqueous solution.

13. A process according to claim 1 wherein step (b) is an evaporation crystallization process of the ash.

14. A process according to claim 1 wherein the method after step (b) further comprises separating the sodium sulphate from the aqueous solution.

* * * * *